United States Patent [19]

Rutz et al.

[11] Patent Number: 4,802,828

[45] Date of Patent: Feb. 7, 1989

[54] TURBINE BLADE HAVING A FUSED METAL-CERAMIC TIP

[75] Inventors: David A. Rutz, Glastonbury; Edward Lee, Higganum; Robert P. Schaefer, East Hartford; Edward L. Johnson, Middletown, all of Conn.

[73] Assignee: United Technologies Corporation, Hartford, Conn.

[21] Appl. No.: 947,066

[22] Filed: Dec. 29, 1986

[51] Int. Cl.[4] ..... B63H 1/26; B64C 11/16; B64C 27/46; F03B 3/12

[52] U.S. Cl. ..... 416/241 B; 51/293; 51/295; 51/308; 415/172 A; 415/174; 416/228; 29/156.8 B

[58] Field of Search ..... 51/308, 293, 295; 415/172 A, 174; 416/241 B, 228; 29/156.8 B

[56] References Cited

U.S. PATENT DOCUMENTS

| | | | |
|---|---|---|---|
| 3,779,726 | 12/1973 | Fisk et al. | 51/295 |
| 4,249,913 | 2/1981 | Johnson et al. | 51/295 |
| 4,589,823 | 5/1986 | Koffel | 415/172 A |
| 4,610,698 | 9/1986 | Eaton et al. | 51/293 |
| 4,689,242 | 8/1987 | Pike | 415/172 A |
| 4,744,725 | 5/1988 | Matarese et al. | 415/172 A |

*Primary Examiner*—Paul Lieberman
*Assistant Examiner*—Willie J. Thompson
*Attorney, Agent, or Firm*—C. G. Nessler

[57] ABSTRACT

A gas turbine engine blade has an abrasive material tip with a fused superalloy matrix and evenly distributed ceramic particulate. The matrix will have a desirable metallurgical structure characterized by fine dendrites and remanants of the original powder metal structure from which it was made. Due to the fusion of the tip, the peripheral edge will tend to be curved. To lessen the effect of thermal strains on such an abrasive tip, a sheath of a superalloy, such as a portion of the turbine blade substrate, extends along the side of the abrasive. The sheath may be present only in the thicker leading edge part of the blade airfoil.

9 Claims, 2 Drawing Sheets

TURBINE BLADE HAVING A FUSED METAL-CERAMIC TIP

TECHNICAL FIELD

The present invention relates to the construction of turbine blades for gas turbine engines, in particular to wear-resisting tip parts of such articles.

BACKGROUND

In the turbine section of gas turbine engine, as well as in other parts, and in other turbomachinery, very close clearances are obtained between the spinning blades of a rotor and the circumscribing structure of the engine case. Occasionally, the tips will come into contact with the circumscribing parts, ordinarily called the seal segments, or simply, seals. To preserve the close clearances necessary for efficient engine operation, experience has shown that this must occur without significant wear of the blade tips. Thus, there has been developed a technology whereby an abradable material is applied to the interior of the case and the tips of the blades are made comparatively wear resistant.

In the pursuit of higher operating temperatures, the friable metals which originally comprised the seals have been replaced by ceramic materials. Even though such material are friable compared to monolithic ceramics, they can cause undue wear on turbine blades. Therefore, it has become the practice to apply to the tips of such blades ceramic particulate containing materials, such as the silicon carbide and superalloy metal matrix material described in commonly owned U.S. Pat. No. 4,243,913 of Johnson et al. The Johnson material is made by hot pressing and sintering a mixture of metal and ceramic powders, and joining the resultant material to the tip of a blade by welding, using transient liquid phase bonding or brazing.

The separately formed abrasive has limitations. Among them are that the forming of the separate piece and ensuring a good bonding surface can be costly; and, that when there is more than 15 volume percent ceramic in the material there is a propensity for cracking. There is also some tendency for failure at the point where the abrasive is bonded.

Others have also made abrasives for protecting the tips of turbine blades. For example, Zelahy et al. in U.S. Pat. No. 4,148,494 describe an electrodeposited combination. Stalker et al. in U.S. Pat. Nos. 4,227,703, 4,169,020 and 4,232,995 describe the use of a composite material structure at the tip in combination with an electrodeposited abrasive surface layer.

Commonly owned patent applications Ser. Nos. 624,446 and 624,421 of Novak et al. disclose plasma sprayed tip abrasives where the ceramic particulate is only one particle thick. The design of turbine blade tips has also been the subject of considerable work, aimed at improving the performance of tips. For example, see the aforementioned Stalker et al. patents and U.S. Pat. No. 4,390,320 to Eiswerth.

Because of the presence of ceramic material and the choice of matrices principally for their ability to hold the ceramic material, the abrasive material as a whole tends to have a different bulk thermal expansion from the superalloy substrate of the turbine blade. Since the use of turbine blades inherently subjects them to thermal cycling, significant cyclic strains are created where the abrasive material and substrate join, and these strains can lead to an undesired failure mode. Similarly, the abrasive material, being inhomogeneous, tends itself to be more prone to internal thermal strains and failure in regions of high temperature differential. For example, after a long period of use, cracks may be caused at the corner edge of the abrasive material at its outer or free surface.

Thus, there is a continuing need for improvements in the field, to obtain good durability with low manufacturing costs.

DISCLOSURE OF THE INVENTION

An object of the invention is to provide turbine blades with abrasive tips which have improved durability, through a combination of metallurgical and structural features. A further object of the invention is to lessen the propensity for abrasive materials to separate from the superalloy substrate of gas turbine engine blades.

According to the invention, a gas turbine blade tip has an abrasive material which has a fused or cast superalloy metal matrix and evenly distributed ceramic particulate contained therein. The tip on the end of an ordinary blade has a cast curved periphery resulting from surface tension on the melted part of the tip which contrasts with the sharper corner of prior art abrasive tips. The tip has a metallurgical structure which reflects the structure of some of the unmelted original material and the fabrication process in which most but not all of the powder metal was melted. In its best embodiment, the tip will have a fine dendritic structure and at least some equiaxed grains, and thus good high temperature properties.

In a preferred aspect of the invention, there is a thin sheath of metal superalloy around the periphery of at least part of the abrasive material. The sheath is a superalloy which has better properties than the ceramic-containing abrasive material, and thereby imparts better thermal fatigue resistance to the structure, as well as tending to provide better adhesion of the abrasive to the substrate. When turbine blades have very thin trailing edges the sheath is only placed in the vicinity of the leading edge, to avoid subtracting unduly from the desired wear resistance of the tip.

The foregoing and other objects, features and advantages of the present invention will become more apparent from the following description of preferred embodiments and accompanying drawings.

BEST MODE FOR CARRYING OUT THE INVENTION

The invention is described in terms of applying an abrasive tip to a gas turbine engine blade made of a nickel superalloy in single crystal form, known as PWA 1480 alloy of the assignee. This alloy, known as PWA 1480 of United Technologies Corporation, Hartford, Conn., USA, is generally described in U.S. Pat. No. 4,209,348 to Duhl et al. The ceramic particulate is a silicon carbide material coated with alumina to impart resistance to interaction with the matrix, similar to that described in the aforementioned patent to Johnson et al. The disclosure of both patents are hereby incorporated by reference.

In the best mode, silicon carbide particulate is included in a fused metal matrix, generally using the techniques described in the commonly assigned copending application Ser. No. 947,067, the disclosure of which is hereby incorporated by reference.

As set forth in more detail in the copending application, 15–25 volume percent alumina coated silicon carbide particulate of —35 +45 mesh U.S. Sieve Size (420–500 micrometer) is mixed with 75–85 volume percent metal particulate of −80 mesh (177 micrometer). The metal particulate is preferably comprised of a nickel superalloy known as Tipaloy 105, being an alloy like that of the Johnson et al. patent but having silicon as a melting point depressant. The nominal composition of the Tipaloy 105 is by weight percent Ni, 25 Cr, 8 W, 4 Ta, 6 Al, 1.2 Si, 1 Hf, 0.1 Y. The ingredients may be mixed with polymer binders and vehicles as is known commonly, for instance to make brazing tapes. See U.S. Pat. Nos. 4,596,746 and 4,563,329.

The foregoing mixture is placed in a part of the blade tip as described below and heated in a vacuum to a temperature sufficient to cause any binders to flee and to cause the metal to fuse and fully densify. Such process is called sintering herein. The heating is limited so that the metal particulate does not entirely melt; typically the temperature of sintering is just below the liquidus temperature. Doing so prevents the particulate from floating to the top of the liquified material, and thus produces a substantially uniform dispersion of ceramic in the metal matrix. Also, the procedure produces a metal matrix which reflects the metallurgical structure of the starting materials. Usually it has at least some equiaxed grains; preferably there is entirely equiaxed grain, but more typically there is 10–70 volume percent equiaxed grain in combination with fine dendritic structure. The fine dendritic structure is compared to the coarser dendritic, and even columnar grain, structure which results when the matrix is fully melted. the desired metallurgical structure produce good high temperature strength.

Figure 1:
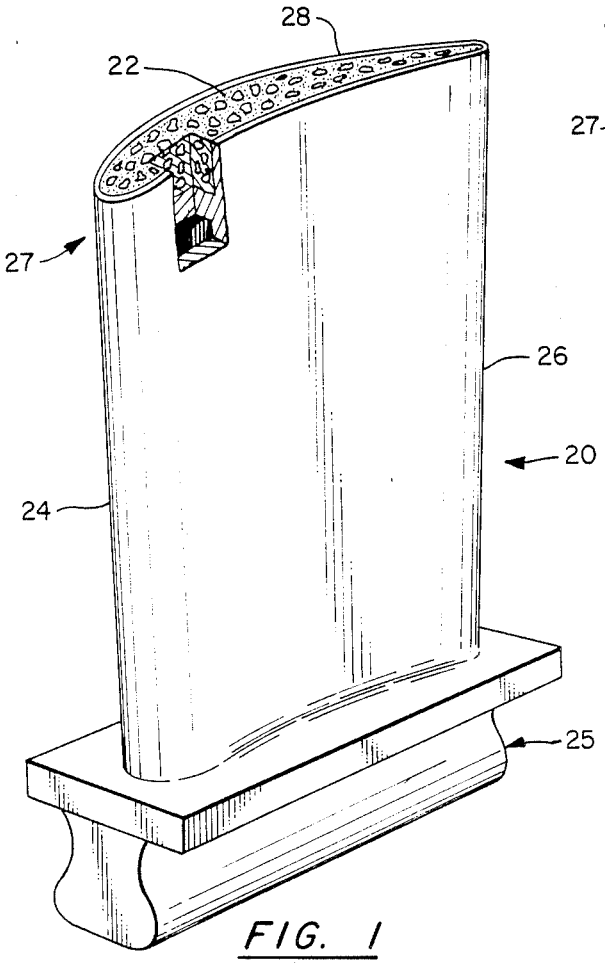
FIG. 1 shows a turbine blade having an abrasive material tip contained within a sheath.
Figure 9:
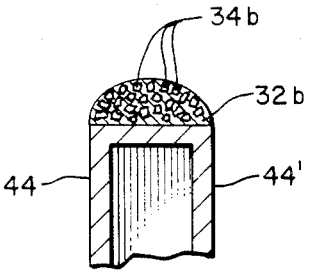
FIG. 9 shows in cross section what a blade tip looks like where there is no sheath.
Figure 10:
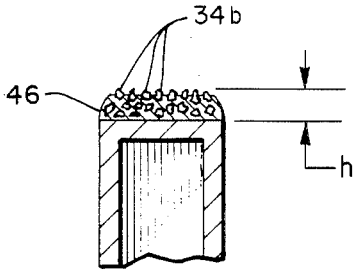
FIG. 10 shows the appearance of the structure in FIG. 9 after machining is finished.

FIG. 9 shows a cross section through the tip of a turbine blade made according to the invention, like that shown in FIG. 1, but without the tip sheath shown in FIG. 1. The abrasive material has a curved shape owing to surface tension forces which acted on its semi-liquid condition. A ceramic stop-off compound, commonly employed in brazing, is used to stop the matrix material 32*b* from running down the airfoil surfaces 44, 4'4 during the fusing operation. Subsequently, the tip will be machined to length (thickness h) and the process described in U.S. Pat. No. 4,522,692 to Joslin will be used to remove part of the matrix and expose the ceramic particulates 34*c*, as shown in FIG. 10. The desirable abrasive tip produced by the process described will have a convex peripheral surface 46 as a result of surface tension during fusion. The more the curvature of the edge, the lesser is the severity of the cooling and thermal strain in the abrasive.

Figure 2:
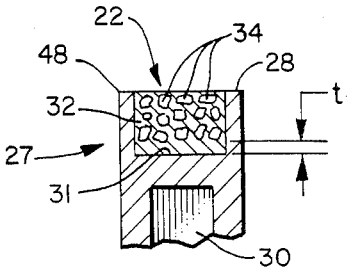
FIG. 2 is a cross section through the tip part of the blade of FIG. 1.

FIG. 1 shows a turbine blade 20 having a root end 25, a tip end 27, and a leading edge 24 and a trailing edge 26. There is an abrasive tip 22 surrounded by a sheath 28 which is an extension of the substrate (or airfoil) of the blade. FIG. 2 shows a cross section through a part of the tip end 27 of the blade. It is seen that the blade has an interior hollow 30 which may be cast or machined. The abrasive tip 22 is comprised of metal matrix 32 and ceramic particles 34. During the aforementioned fusion, the walls 28 as well as the floor 31 of the concavity of the blade tip are wetted by the matrix. Sufficient material provided before sintering causes the fused mass to fill the concavity of the tip.

Figure 3:
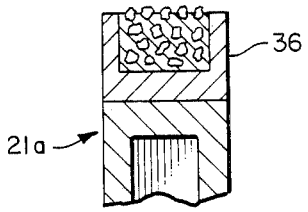
FIG. 3 is a cross section through the tip part of a blade made separately and then joined to the blade.

The containment of the abrasive material within the sheath of the blade provides the tip with added durability. Generally, the abrasive material will not be as strong, thermal fatigue resistant or oxidation resistant as the blade substrate, because of the compromises that are made to depress the melting point and obtain the requisite densification, and the presence of the ceramic pieces. Furthermore, the abrasive does not have the desirable single crystal structure of the preferred PWA 1480 substrate. Thus, the sheath preferably extends substantially fully along the airfoil length (thickness) of the abrasive so that the nominal top sheath corner 48 experiences the most severe thermal strains and protects the abrasive, thereby improving crack resistance. Lesser advantage is obtained if the sheath does not extend the full length. (As shown in FIG. 3, the etching to expose grains, as described in connection with Fig. 10, may correspondingly mean that the sheath will also be removed and not extend exactly to the outermost tip of the blade. But the sheath will still be considered to extend the full length of the abrasive tip.)

Also, it will be appreciated that sheath presence means that the abrasive is bonded on by more surface area, namely by adhesion at the the sides of the abrasive, compared to there being no sheath. This improves the resistance of the abrasive to separation from the tip at the surface 31. However, in achieving these advantages, the amount of sheath is kept to a minimum to maintain the maximum abrasive material presence. Therefore, the sheath wall thickness is kept to a thickness of about 0.010–0.020 inch in a typical application.

Figure 4:
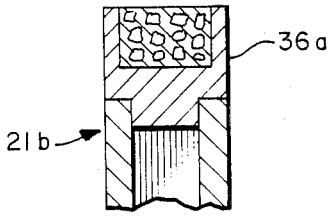
FIG. 4 shows the cross section of another embodiment, similar to that shown in FIG. 3.

FIG. 3 and FIG. 4 show different embodiments of the invention, wherein the tip parts 36, 36*a* are separately made, as by casting, and then bonded to the blade end 21*a*, 21*b*, as by liquid phase diffusion bonding or brazing. The casting may be the same or a similar superalloy to that of the substrate.

However, even though the sheath is thin, the trailing edge of many blades is very narrow and the presence of the sheath in such regions subtracts too much from the quantity of abrasive material which can be present there, and thus from its wear resistance. Thus, the sheath may be made thinner at the trailing edge than at the leading edge.

Figure 5:
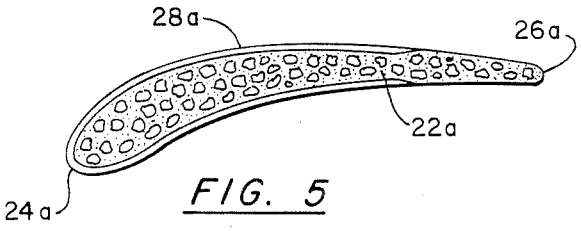
FIG. 5 is a top view of a blade tip, showing a partial sheath.
Figure 6:
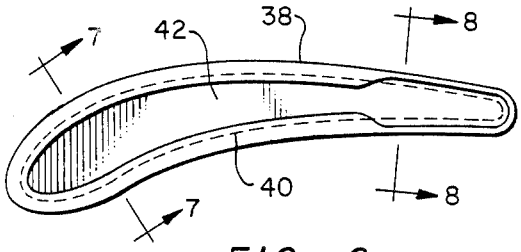
FIG. 6 is a top view of a blade tip, illustrating how a separate casting fits with the underlying shape of the blade tip.
Figure 7:
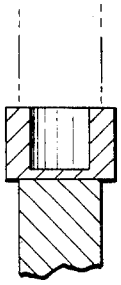
FIGS. 7 and 8 are cross sections through the structure shown in FIG. 6.
Figure 8:
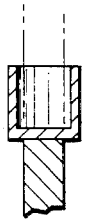

A blade tip like that shown from the top view in FIG. 5 may also be constructed. The sheath 28*a* is only present around the abrasive material 22*a* at the leading edge end 24*a* and not at the trialing edge end 26*a*. How this part is made is illustrated by FIG. 6-8. FIG. 6 shows in top view the separate cast part 38 (referred to as a "boat" casting) as it rests on the airfoil of the blade, shown in phantom by line 40. The interior cavity 42 of the boat is irregular. Although still approximately the shape of the airfoil, the width of the boat concavity is greater at the trailing edge than at the leading edge, compared to the projection of the airfoil.

The concavity of the boat is filled with abrasive tip material; the boat is bonded to the airfoil; and, it is then machined so that the peripheral dimensions are extensions of the airfoil surface 40, to give the structure shown in FIG. 5. FIG. 7 and 8 illustrate by cross section how the machining away of the overhanging parts of the blade provides the desired configuration. The part just described can also be made by having the boat portion an integral part of the orignal casting.

Of course, the aspect of the invention just described can be fabricated by making the structure prior to machining integral with the casting, rather than a separate boat casting. The choice of approach will be dictated by manufacturing factors.

Generally, the invention involves the use of an abrasive material having a metal matrix selected from the superalloy group based on nickel, cobalt, iron or mixtures thereof. Preferably the superalloy will contain a reactive metal selected from the group consisting of essentially Y, Hf, Ti, Mo, Mn and mixtures thereof, to improve adherence of the matrix to the substrate and ceramic. Also, it is often preferred that there be a melting point depressant and bonding aid such as S, P, B or C. The ceramic particulate will be a refractory material, usually composed of an oxide, carbide, nitride or combinations thereof. Preferably the ceramic will be a material selected from the group consisting of essentially silicon carbide, silicon nitride, silicon-aluminumoxynitride (SiAlON) and mixtures thereof.

Although this invention has been shown and described with respect to a preferred embodiment, it will be understood by those skilled in the art that various changes in the form and detail thereof may be made without departing from the spirit and scope of the claimed invention.

We claim:

1. A gas turbine engine blade made of a superalloy, comprised of a substrate having an abrasive tip made of ceramic particulate in a predominately fused metal matrix characterized by the blade having a superalloy sheath containing no ceramic particulates along a portion of the periphery of the abrasive tip part, the sheath being attached to the substrate of the blade.

2. The blade of claim 1 characterized by a sheath which is an extension of the blade substrate.

3. The blade of claim 1 characterized by a sheath which is a portion of a separately formed casting attached to the blade substrate.

4. The blade of claim 1 characterized by a sheath which extends substantially to the outermost surface of the abrasive tip.

5. The blade of claim 1 characterized by a sheath which is thinner at the blade trailing edge than at the leading edge.

6. The blade of claim 1 characterized by the sheath only being present at the leading edge.

7. The method of making a gas turbine engine blade having an abrasive tip of ceramic particulate and fused metal matrix, with a metal sheath around a portion of the tip, characterized by fusing the abrasive tip material within a part at the tip end of the blade; the part having a concavity with approximately the shape of the end of the airfoil at the tip of the blade; and machining the part to remove a portion of thereof which defines the concavity, to produce an abrasive tip, the periphery of which is only partially surrounded by a sheath.

8. The blade of claim 1 wherein the matrix is characterized by a fine dendritic structure in combination with the equiaxed grain structure.

9. The blade of claim 1 having an abrasive tip composed of 75 or more volume percent superalloy matrix, balance ceramic selected from the group consisting of oxides, carbides, nitrides and mixtures thereof.

* * * * *